US008448938B2

(12) United States Patent
Ko

(10) Patent No.: US 8,448,938 B2
(45) Date of Patent: May 28, 2013

(54) MEDIUM SUPPLYING UNIT AND IMAGE FORMING APPARATUS HAVING THE SAME

(75) Inventor: Young-soo Ko, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 245 days.

(21) Appl. No.: 12/540,488

(22) Filed: Aug. 13, 2009

(65) Prior Publication Data

US 2010/0044956 A1 Feb. 25, 2010

(30) Foreign Application Priority Data

Aug. 19, 2008 (KR) ..... 10-2008-0081041

(51) Int. Cl.
*B65H 1/08* (2006.01)

(52) U.S. Cl.
USPC ..... 271/127; 271/160; 271/162; 271/126

(58) Field of Classification Search
USPC ..... 271/157, 160, 162, 145, 164, 126, 271/127
See application file for complete search history.

(56) References Cited

U.S. PATENT DOCUMENTS

| | | | | |
|---|---|---|---|---|
| 4,017,181 | A * | 4/1977 | Komaba et al. | 355/72 |
| 4,280,692 | A * | 7/1981 | Hutchinson et al. | 271/160 |
| 4,444,386 | A * | 4/1984 | Murata et al. | 271/127 |
| 5,201,873 | A * | 4/1993 | Kikuchi et al. | 271/9.13 |
| 5,232,214 | A * | 8/1993 | Matsuura et al. | 271/127 |
| 5,232,215 | A * | 8/1993 | Hashimoto et al. | 271/160 |
| 5,338,021 | A * | 8/1994 | Shirai | 271/160 |
| 5,419,544 | A * | 5/1995 | Ono et al. | 271/164 |
| 6,435,499 | B1 * | 8/2002 | Tomatsu | 271/147 |
| 7,540,493 | B2 * | 6/2009 | Konishi | 271/157 |
| 7,708,265 | B2 * | 5/2010 | Kusama | 271/117 |
| 2002/0063374 | A1 * | 5/2002 | Takahashi | 271/10.01 |
| 2004/0036207 | A1 * | 2/2004 | Lee et al. | 271/157 |
| 2005/0253327 | A1 * | 11/2005 | Soo | 271/157 |
| 2007/0200284 | A1 * | 8/2007 | Takahashi | 271/160 |
| 2009/0057988 | A1 * | 3/2009 | Fukumasu | 271/145 |

FOREIGN PATENT DOCUMENTS

| | | |
|---|---|---|
| KR | 2006-0112126 | 10/2006 |
| KR | 2007-0025524 | 3/2007 |

OTHER PUBLICATIONS

Korean Notice of Allowance dated Oct. 26, 2012 issued in Korean Application No. 2008-0081041.

* cited by examiner

*Primary Examiner* — Prasad Gokhale
(74) *Attorney, Agent, or Firm* — Stanzione & Kim, LLP

(57) ABSTRACT

A medium supplying unit and an image forming apparatus having the same. The medium supplying unit includes a cassette frame to be mounted to or detached from a main body frame, a loading plate to load a printing medium, and is disposed adjacent to the cassette frame to move between a supplying position and a standby position, and a locking assembly. The locking assembly includes an engagement unit disposed adjacent to the loading plate and a locking unit, the locking unit including a stationary end extending from the cassette frame, and a free end to lock the engagement unit if the loading plate is positioned in the standby position, and to move the free end in a direction to unlock the engagement unit by applying a pressing force so that the loading plate can move to the supplying position when mounting the cassette frame.

20 Claims, 7 Drawing Sheets

MEDIUM SUPPLYING UNIT AND IMAGE FORMING APPARATUS HAVING THE SAME

CROSS-REFERENCE TO RELATED APPLICATIONS

This application claims priority under 35 U.S.C. §119(a) from Korean Patent Application No. 10-2008-0081041, filed on Aug. 19, 2008 in the Korean Intellectual Property Office, the disclosure of which is incorporated herein by reference in its entirety.

BACKGROUND

1. Field of the Invention

The present general inventive concept relates to a medium supplying unit to supply a printing medium and an image forming apparatus having the same, and more particularly, to a medium supplying unit to lock the position of a loading plate when loading a printing medium and an image forming apparatus having the same.

2. Description of the Related Art

An image forming apparatus performs a printing operation for forming image data received from a host as a visible image on a printing medium by using a developer or an ink. For this, the image forming apparatus includes a medium supplying unit to which a plurality of printing mediums are loaded, and the medium supplying unit supplies the loaded printing mediums one by one in a printing operation.

A medium supplying unit employed by a conventional image forming apparatus includes a cassette frame detachably coupled to a main body frame, and a loading plate rotatably disposed at the cassette frame and loading a printing medium. Also, an elastic member is interposed between the loading plate and a surface of the cassette frame, and a latch configuration to overcome an elastic force of the elastic member to lock the position of the loading plate is provided.

With this configuration, if a user mounts the cassette frame to the main body frame after loading printing media on the loading plate locked by the latch, the locking by the latch is withdrawn, and accordingly, the loading plate upwardly rotates to a supplying position of the printing media by the elastic member.

However, the conventional medium supplying unit for the image forming apparatus forms the above latch configuration by assembling various components such as a latch, a stopper, a spring, etc. Since the separate components are respectively manufactured and assembled, manufacturing costs and processes increase, and tolerance among the components should be taken into consideration in designing the components. Also, if the number of components increases, since the configuration thereof becomes complicated, it is apt to be out of order.

In the conventional latch configuration, the spring is provided. Since the elastic force of the spring decreases as time elapses, operation of the latch configuration may fail to be stably performed.

SUMMARY

Accordingly, the present general inventive concept provides a medium supplying unit capable of locking and releasing the position of a rotating loading plate with a simple configuration, and an image forming apparatus having the same.

The present general inventive concept also provides a medium supplying unit that does not employ a separate spring to be applied to a conventional latch configuration, and an image forming apparatus having the same.

Additional features and utilities of the present general inventive concept will be set forth in part in the description which follows and, in part, will be obvious from the description, or may be learned by practice of the general inventive concept.

Embodiments of the present general inventive concept can be achieved by providing a medium supplying unit of an image forming apparatus, including a cassette frame to be mounted to or detached from a main body frame, a loading plate to load a printing medium, and is disposed adjacent to the cassette frame to move between a supplying position and a standby position, and a locking assembly including an engagement unit disposed adjacent to the loading plate and a locking unit, the locking unit including a stationary end extending from the cassette frame, and a free end to lock the engagement unit if the loading plate is positioned in the standby position, and to move the free end in a direction to unlock the engagement unit by applying a pressing force so that the loading plate can move to the supplying position when mounting the cassette frame.

The locking assembly may further include a pressing unit which is disposed adjacent to the main body frame to press the free end in the direction to unlock the engagement unit when mounting the cassette frame.

The free end may include a locking unit main body which extends from the stationary end to lock the engagement unit thereto, and a pressed unit which extends from the locking unit main body, and is pressed by the pressing unit to move the free end.

An external surface of the pressed unit may have a round shape.

The engagement unit may include a hook unit which is formed at an end part of the engagement unit to engage and be released from the locking unit main body.

The locking unit main body may be formed with an engagement hole through which the engagement unit passes and to which the hook unit is engaged.

A relationship between a moving distance L1 of the free end by the pressing unit, and an engagement width L2 of the hook unit which is engaged to the locking unit main body may satisfy the equation: $1.5 \leqq L1/L2 \leqq 3.0$.

The pressing unit may include an incline unit which presses the free end so that free end can gradually move when mounting and detaching the cassette frame.

The locking unit may include a frame structure which forms an external surface of the free end by a frame which extends from the stationary end.

A relationship between the width W1 of the stationary end, and the width W2 of the frame which forms the free end may satisfy the equation: $2.0 \leqq W1/W2 \leqq 3.0$.

The locking unit may be integrally formed to the cassette frame.

Embodiments of the present general inventive concept can also be achieved by providing an image forming apparatus, including an image forming unit to form an image on a printing medium and a medium supplying unit to supply the printing medium to the image forming unit, the medium supplying unit may include a cassette frame to be mounted to or detached from a main body frame, a loading plate to load a printing medium, and is disposed adjacent to the cassette frame to move between a supplying position and a standby position, and a locking assembly including an engagement unit disposed adjacent to the loading plate and a locking unit, the locket unit including a stationary end extending from the cassette frame, and a free end to lock the engagement unit if the loading plate is positioned in the standby position, and to move the free end in a direction to unlock the engagement unit by applying a pressing force so that the loading plate can move to the supplying position when mounting the cassette frame.

Embodiments of the present general inventive concept can also be achieved by providing locking assembly for use in a medium supplying unit of an image forming apparatus, the locking assembly including an engagement unit, and a locking unit to lock the engagement unit when the locking unit is in an original position to lock the loading plate in a standby position and to unlock the engagement unit when the locking unit is in a pressed position to release the loading plate from the standby position.

The locking assembly may further include a pressing unit to move the locking unit between the original position and the pressed position.

The locking unit may include a stationary end and a free end extending from the stationary end, the free end including a locking unit main body to facilitate the locking of the engagement unit, an engagement hole to accommodate the engagement unit, and a pressed unit to be pressed by the pressing unit.

The engagement unit may include a main body to pass through the engagement hole, and a hook unit to engage the locking unit main body in order to lock the engagement unit.

The pressing unit may include a first incline unit to move the free end from the original position to the pressed position, and a second incline unit to move the free end from the pressed position to the original position.

BRIEF DESCRIPTION OF THE DRAWINGS

These and/or other features and utilities of the present general inventive concept will become apparent and more readily appreciated from the following description of the exemplary embodiments, taken in conjunction with the accompanying drawings of which.

DETAILED DESCRIPTION OF THE EMBODIMENTS

Figure 1:
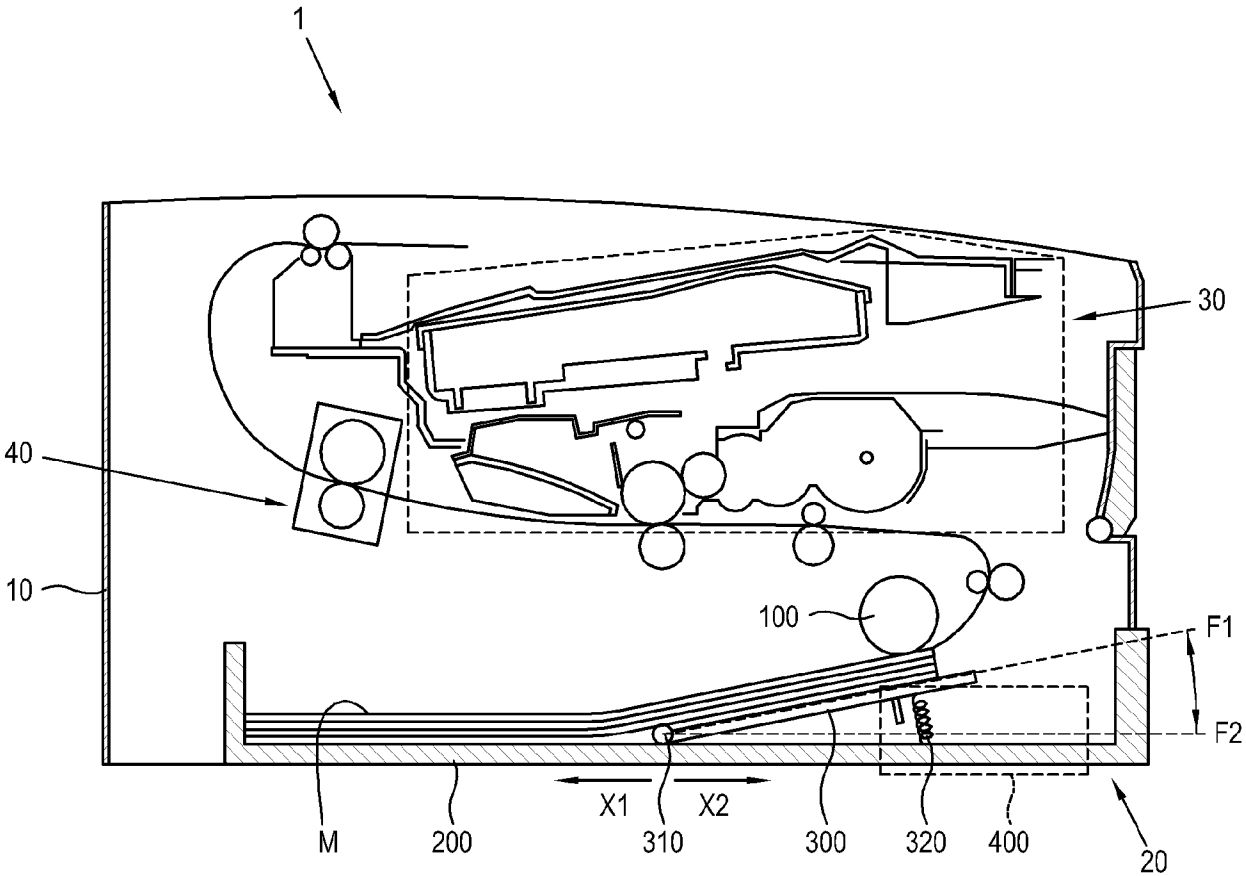
FIG. 1 illustrates a side sectional view of an image forming apparatus including a medium supplying unit according to an exemplary embodiment of the present general inventive concept.

Reference will now be made in detail to the exemplary embodiments of the present general inventive concept, examples of which are illustrated in the accompanying drawings, wherein like reference numerals refer to like elements throughout. The exemplary embodiments are described below so as to explain the present general inventive concept by refer to the figures. Repetitive description with respect to like elements of different exemplary embodiments may be omitted for the convenience of clarity.

FIG. 1 illustrates a side sectional view of an image forming apparatus 1 including a medium supplying unit 20 according to an exemplary embodiment of the present general inventive concept. In the present exemplary embodiment, the medium supplying unit 20 is illustrated as being used with the image forming apparatus 1 of a mono image forming type to form a single color image by a single color developer on a printing medium. However, the present general inventive concept is not limited thereto, and for example, the medium supplying unit 20 according to the present exemplary embodiment may be used with an image forming apparatus of a type to form a color image.

As illustrated in FIG. 1, the image forming apparatus 1 includes a main body frame 10, the medium supplying unit 20 to which printing media M is loaded and supplied, an image forming unit 30 to form an image by a developer on the supplied printing medium M, and a fusing unit 40 to fuse the image on the printing medium M.

Hereinafter, the medium supplying unit 20 according to the present exemplary embodiment will be described in detail.

As illustrated in FIG. 1, the medium supplying unit 20 includes a cassette frame 200 detachably mounted to the main body frame 10, a loading plate 300 rotatably disposed adjacent to the cassette frame 200, and a locking assembly 400 to lock and release the loading plate 300.

The cassette frame 200 is capable of being mounted to or detached from the main body frame 10. FIG. 1 illustrates a state in which the cassette frame 200 is completely mounted to the main body frame 10. Here, a direction in which the detached cassette frame 200 becomes mounted to the main body frame 10 refers to a direction X1, and a direction in which the completely mounted cassette frame 200 becomes detached from the main body frame 10 refers to a direction X2. As illustrated in FIG. 1, the directions X1 and X2 are opposite from each other.

The printing medium M is loaded to an inner side of the cassette frame 200. The loading plate 300 is rotatably coupled to a surface of the cassette frame 200 on which the printing medium M is loaded by a hinge unit 310, and the printing medium M is loaded on an upper surface of the loading plate 300.

A first end part of the loading plate 300 rotates about a second end part of the loading plate 300 coupled to the cassette frame 200 by the hinge unit 310. An elastic member 320 is interposed between the cassette frame 200 and a lower surface of the loading plate 300, that is, the opposite surface of the upper surface of the loading plate 300 on which the printing medium M is loaded. The elastic member 320 may include a member of various types capable of applying an elastic force against the loading plate 300 such as a coil spring, a leaf spring, etc., and the number of elastic members 320 of the various types are not limited.

By the interposition of the elastic member 320 between the cassette frame 200 and the loading plate 300, the loading plate 300 rotates about the hinge unit 310 in a direction in which an elastic force of the elastic member 320 is applied. Here, since the printing medium M is loaded on the upper surface of the loading plate 300, the elastic member 320 causes the loading plate 300 to rotate upwards, and accordingly, inclines to a loading position of the printing medium M. This inclined position of the loading plate 300 refers to a supplying position F1.

On the other hand, if an external force applied to the loading plate 300 overcomes the elastic pressing force of the elastic member 320, the loading plate 300 rotates downward to approach an upper surface of the cassette frame 200. Accordingly, the loading position of the printing medium M moves downwardly. This declined position of the loading plate 300 refers to a standby position F2. In other words, the loading plate 300 is capable of rotating between the supplying position F1 and the standby position F2.

As illustrated in FIG. 1, when the cassette frame 200 is completely mounted to the main body frame 10, the loading plate 300 is positioned in the supplying position F1. Accordingly, a pickup roller 100 disposed in the main body frame 10 can supply the printing medium M from a top surface of the loading plate 300 to the image forming unit 30.

On the other hand, when the cassette frame 200 is detached from the main body frame 10, a user loads the printing media M in the cassette frame 200. The loading plate 300 is pressed by a user to overcome the elastic force of the elastic member 320 so that the loading plate 300 can move to the standby position F2. The loading plate 300 then moves from the standby position F2 to the supplying position F1 when the pressure is released from the loading plate 300 and the cassette frame 200 is mounted back to the main body frame 10.

Figure 2:
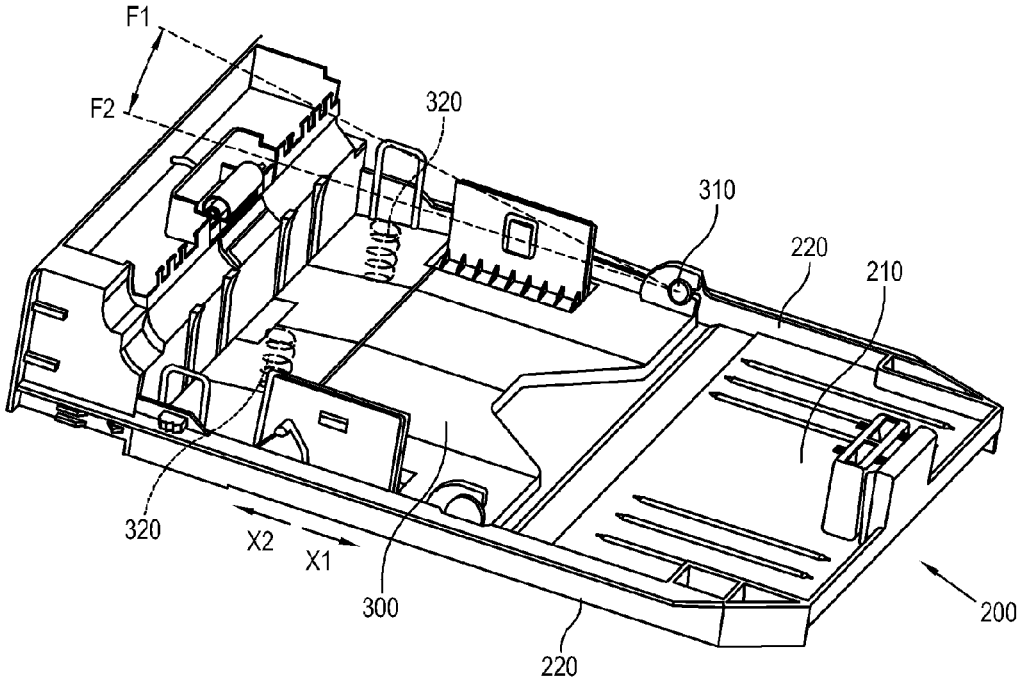
FIG. 2 is a perspective view illustrating a standby position of a loading plate in the medium supplying unit as illustrated in FIG. 1.

FIG. 2 is a perspective view illustrating the standby position F2 of the loading plate 300 in the medium supplying unit 20 according to the present exemplary embodiment.

As illustrated in FIG. 2, the cassette frame 200 includes a base 210 having a rectangular plate shape parallel with an installation surface, and side walls 220 standing in a circumference of the base 210. The loading plate 300 is disposed on a surface of the base 210, and the hinge unit 310 is disposed adjacent to each side wall 220 facing each other and being parallel in the direction X1. Also, the elastic member 320 is interposed between the surface of the base 210 and the lower surface of the loading plate 300 so that the loading plate 300 can rotate upwards about the hinge unit 310.

A user loads the printing media M on the loading plate 300 and the surface of the base 210, and downwardly presses the loading plate 300. Accordingly, the elastic force of the elastic member 320 is overcome, and the loading plate 300 rotates from the supplying position F1 to the standby position F2.

The loading plate 300 may maintain the standby position F2 when the cassette frame 200 is detached from the main body frame 10, and may move to the supplying position F1 while the cassette frame 200 is being mounted to the main body frame 10.

Maintaining the standby position F2 prevents interference between the pickup roller 100 and the loading plate 300 before the cassette frame 200 is mounted to the main body frame 10. When the cassette frame 200 is mounted to the main body frame 10, the printing media M presses against the pickup roller 100 with a uniform pressure as the loading plate 300 moves upwards based on the elastic force of the elastic member 320 applied to the lower surface of the loading plate 300. The locking assembly 400 is disposed adjacent to a lower surface of the medium supplying unit 20 to accomplish this.

Hereinafter, the locking assembly 400 will be described while referring to FIG. 3.

Figure 3:
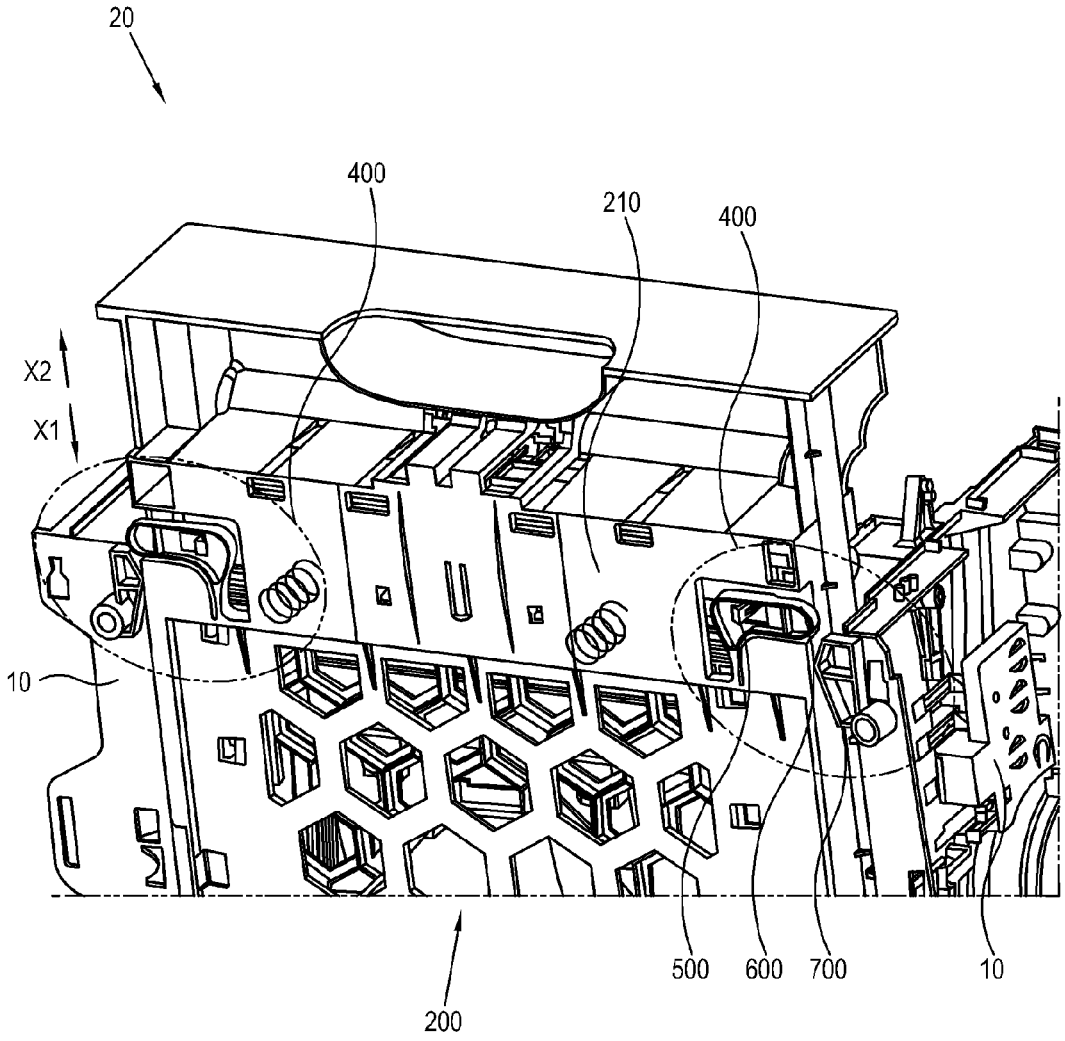
FIG. 3 is a perspective view illustrating a state in which a cassette frame is mounted to a main body frame viewed from a lower side of the cassette frame in the medium supplying unit as illustrated in FIG. 1.

FIG. 3 is a perspective view illustrating a state in which the cassette frame 200, as illustrated in FIG. 2, is mounted to the main body frame 10 viewed from a lower side of the cassette frame 200.

As illustrated in FIG. 3, the locking assembly 400 locks the loading plate 300 so that when the loading plate 300 rotates to the standby position F2, the loading plate 300 can maintain the standby position F2. In other words, when the loading plate rotates to the standby position F2, the locking assembly 400 locks the loading plate 300 in the standby position F2. Also, the locking assembly 400 releases the loading plate 300 if a user mounts the cassette frame 200 to the main body frame 10 when the loading plate 300 is locked in the standby position F2. When the locking assembly 400 releases, the loading plate 300 rotates to the supplying position F1 by the elastic force of the elastic member 320. Accordingly, the pickup roller 100 picks up the printing medium M to be supplied to the image forming unit 30 for a printing operation.

The locking assembly 400 may include the following configurations for performing this operation. The locking assembly 400 may include an engagement unit 500, a locking unit 600, and a pressing unit 700. The engagement unit may be disposed on a lower surface of the loading plate 300, the locking unit 600 may be disposed on a surface of the cassette frame 200 to lock and release the engagement unit 500, and the pressing unit 700 may be disposed adjacent to the main body frame 10 to press the locking unit 600 in order to enable the locking of the engagement unit 500 by the locking unit 600 to be released when the cassette frame 200 is mounted to the main body frame 10.

Hereinafter, subordinate components of the locking assembly 400 will be described by referring to FIG. 4.

Figure 4:
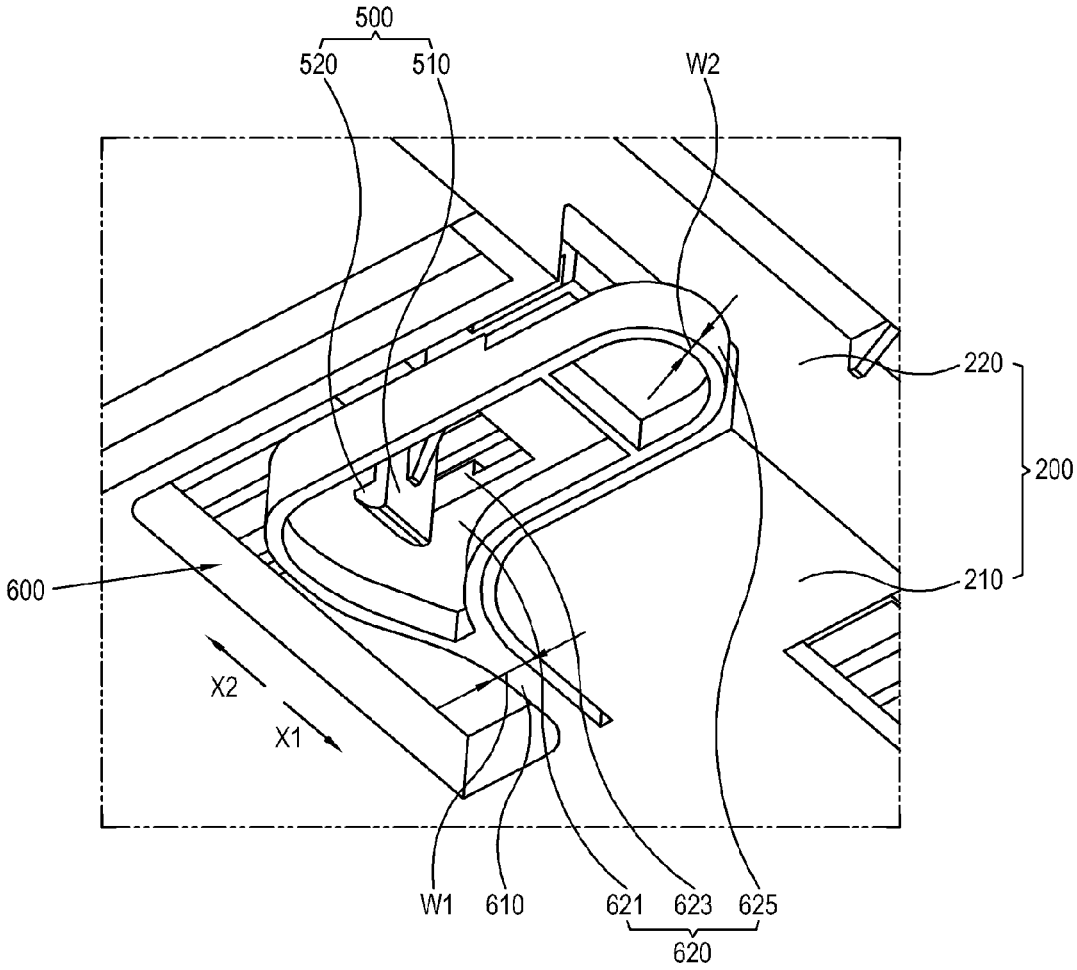
FIG. 4 is a partial perspective view illustrating a configuration of a locking assembly when the loading plate is the standby position in the medium supplying unit as illustrated in FIG. 3.

FIG. 4 is a partial perspective view illustrating the locking assembly 400 which illustrates a state in which the engagement unit 500 is locked by the locking unit 600 so that the loading plate 300 maintains the standby position F2.

As illustrated in FIG. 4, the engagement unit 500 extends from the lower surface of the loading plate 300 toward the base 210. The engagement unit 500 includes an engagement unit main body 510 extending from the loading plate 300, and a hook unit 520 formed at an end part of the engagement unit main body 510 to be engaged to and released from the locking unit 600.

The locking unit 600 is provided on a surface of the base 210 in which the engagement unit 500 is positioned when the loading plate 300 is in the standby position F2. The locking unit 600 is integrally formed with the base 210, and therefore, the locking unit 600 may be formed together when the cassette frame 200 is manufactured, such as by injection molding, or alternative methods. The locking unit 600 may be formed of the same material as the cassette frame 200. For example, the locking unit 600 and the cassette frame 200 may be formed of materials such as acrylonitrile butadiene styrene (ABS), high impact polystyrene (HIPS), polycarbonate (PC), etc.

The locking unit 600 includes a stationary end 610 extending from the cassette frame 200, and a free end 620 extending from the stationary end 610. The free end 620 moves so that the free end 620 can lock the engagement unit 500, and a side thereof can be pressed by the pressing unit 700 to release the locking of the engagement unit 500. The free end 620 moves from an original position to a pressed position. When the free end 620 moves from the original position to the pressed position, the engagement unit 500 moves into position to be locked by the free end 620. Then, when the free end 620 moves from the pressed position back to the original position, the engagement unit 500 is locked by the free end 620. The movement of the free end 620 from the original position to the pressed position may also be used to unlock the engagement unit 500 from the locking unit 600.

The free end 620 is formed by frame or rib configurations extending from the stationary end 610 along an external surface thereof. That is, the free end 620 has a frame structure, the external surface of which is formed by a frame extending from the stationary end 610.

The relation between the width of the frame or rib forming the free end 620, and the width of the stationary end 610 satisfies the following Expression 1.

$$2.0 \leqq W1/W2 \leqq 3.0 \quad \text{Expression 1}$$

Here, W1 refers to the width of the stationary end 610, and W2 refers to the width of the frame forming the free end 620. W1 is equal to or more than twice that of W2 to maintain the elastic restoring force and strength of the locking unit 600. W1 may be less than or equal to three times W2 in order to address a contraction problem according to the material of the locking unit 600. If W1 is less than twice that of W2, or more than three times that of W2, the stationary end 610 is apt to crack or become damaged, and it may be difficult for the free end 620 to move easily between the original position and the pressed position.

The free end 620 includes a locking unit main body 621 to which the engagement unit 500 is locked, and a pressed unit 625 extending from the locking unit main body 621 to be pressed by the pressing unit 700.

The locking unit main body 621 includes a plate formed to an inner area of the frame forming the free end 620 to be parallel with a surface of the base 210, and the plate is formed with an engagement hole 623 through which the engagement unit 500 passes and to which the hook unit 520 is engaged. If the loading plate 300 in the supplying position F1 is pressed downward to move to the standby position F2, the engagement unit 500 passes through the engagement hole 623. The hook unit 520 may cause the free end 620 to move from the original position towards the pressed position by sliding along a surface of the locking unit main body 621 and through the engagement hole 623. The free end 620 may then return to the original position once the hook unit 520 is completely through the engagement hole 623, thus locking the engagement unit 500 so that the loading plate 300 is locked in the standby position F2. If the downward force applied to the loading plate 300 is withdrawn, the elastic member 320 presses the loading plate 300 upwards, toward the supplying position F1. However, since the hook unit 520 is engaged to the engagement hole 623 and a surface of the locking unit main body 621, the loading plate maintains the standby position F2.

The pressed unit 625 extends from the locking unit main body 621 to be pressed by the pressing unit 700 when the cassette frame 200 is being mounted to the main body frame 10. At least a part of the pressed unit 625 protrudes out of each of the side walls 220 when an external force is not applied to the pressed unit 625, for example, when the cassette frame 200 is not mounted to the main body frame 10. This allows the pressing unit 700 to easily perform the pressing of the pressed unit 625. The pressed unit 625 may be formed in such a way that a circumference thereof has a round shape to easily slide with respect to the pressing unit 700 when the cassette frame 200 is mounted. However, the shape of the pressing unit 700 is not limited thereto.

Hereinafter, a releasing configuration of the locking of the engagement unit 500 by the locking unit 600 will be described by referring to FIG. 5.

Figure 5:
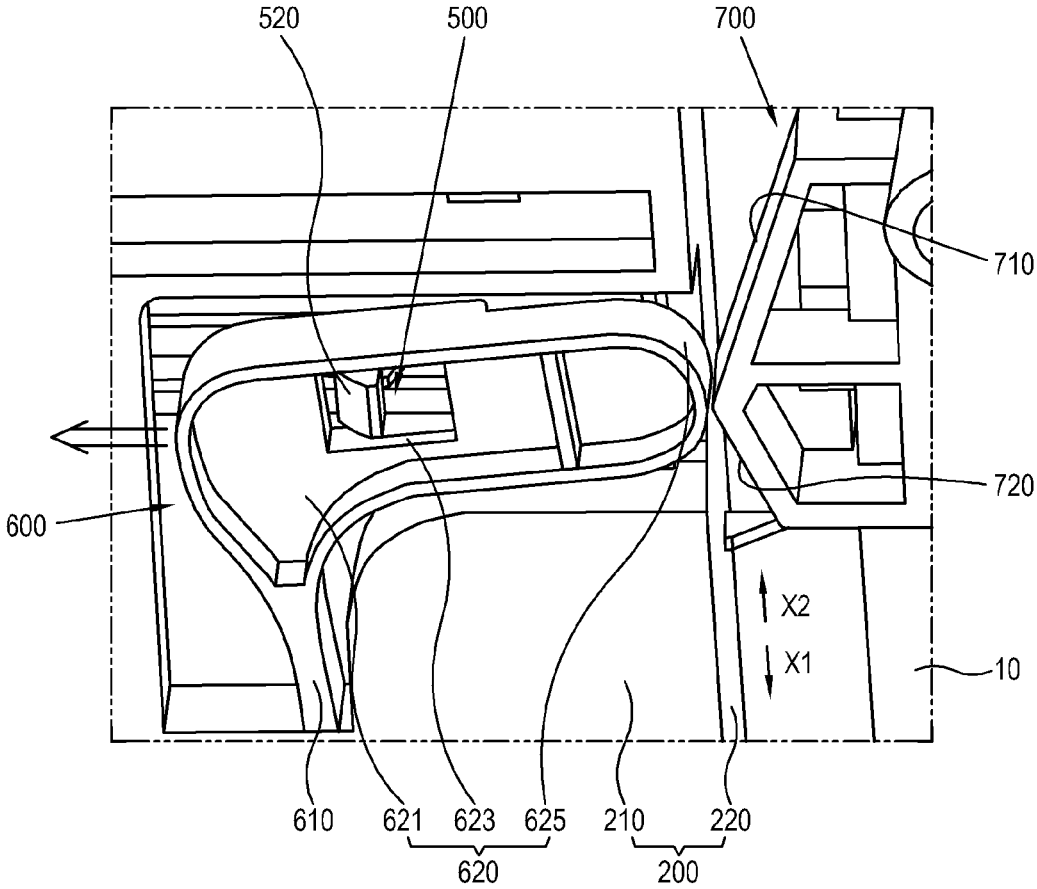
FIG. 5 is a partial perspective view illustrating a configuration of the locking assembly when a locking unit is pressed by a pressing unit in the medium supplying unit as illustrated in FIG. 3.

FIG. 5 is a perspective view illustrating a state in which the locking of the engagement unit 500 by the locking unit 600 is released when the cassette frame 200 in FIG. 4 is mounted to the main body frame 10.

As illustrated in FIG. 5, the pressing unit 700 is coupled to the main body frame 10, and is disposed on a proceeding path, directions X1 and X2, of the pressed unit 625. Accordingly, when the cassette frame 200 is mounted to the main body frame 10, the pressing unit 700 presses the pressed unit 625 to move the free end 620.

The pressing unit 700 includes a first incline unit 710 and a second incline unit 720 to press against the pressed unit 625 so that the free unit 620 can gradually move to the pressed position and return to the original position when mounting and detaching the cassette frame 200. The pressed unit 625 contacts to the first incline unit 710 and the second incline unit 720 to slide, thereby preventing the free end 620 from moving rapidly, and preventing the stationary end 610 from receiving a sudden excessive force.

If the cassette frame 200 moves in the direction X1 as the cassette frame 200 is mounted to the main body frame 10, the pressed unit 625 slides along the first incline unit 710, and accordingly, the free end 620 moves away from the pressing unit towards the pressed position. Accordingly, the locking unit main body 621 and the engagement hole 623 move in a protruding direction of the hook unit 520 that corresponds to a movement of the free end 620 from the original position to the pressed position.

The pressing force applied with respect to the pressed unit 625 reaches a predetermined critical value, for example, if the pressed unit 625 reaches a portion of the pressing unit 700 where the first incline unit 710 and the second incline unit 720 meet, the engagement hole 623 is completely separated from the hook unit 520. When the pressing force applied to the pressed unit 625 reaches the predetermined critical value, the free end 620 is in the pressed position. If the engagement of the hook unit 520 with respect to the engagement hole 623 is withdrawn, the elastic force of the elastic member 320 is able to rotate the loading plate 300 upwards. Accordingly, the elastic force of the elastic member 320 is applied to the loading plate 300, and the loading plate 300 rotates from the standby position F2 to the supplying position F1.

If the cassette frame 200 further moves in the direction X1, the pressed unit 625 slidingly moves along the second incline unit 720, and the free end 620 gradually moves to the original position. When the pressed unit 625 is no longer in contact with the pressing unit 700, the free end 620 returns to the original position.

Hereinafter, the configuration of the locking assembly 400 to lock or release the loading plate 300 will be described in more detail while referring to FIGS. 6 and 7.

Figure 6:
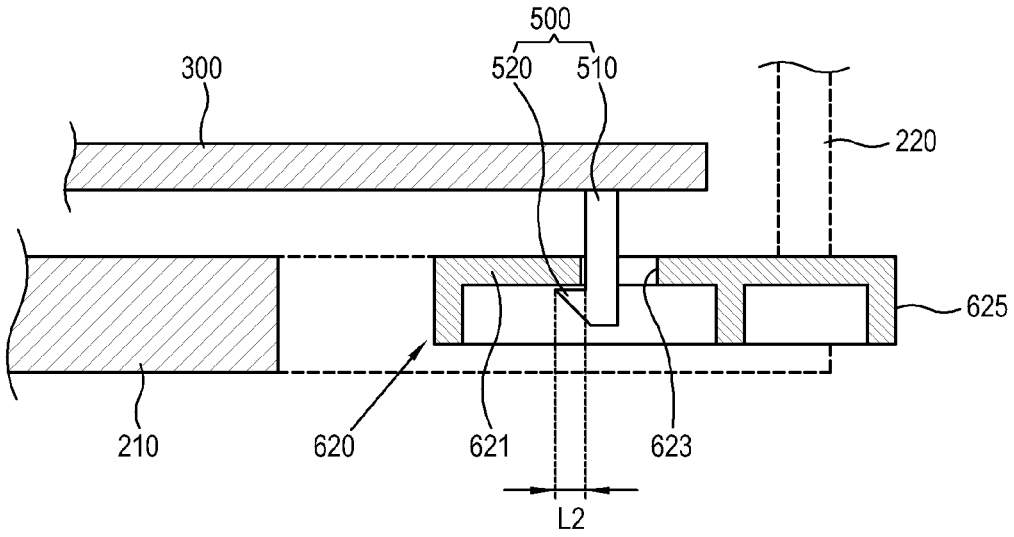
FIG. 6 is a partial sectional view illustrating the locking assembly as illustrated in FIG. 4 viewed in a direction X1.
Figure 7:
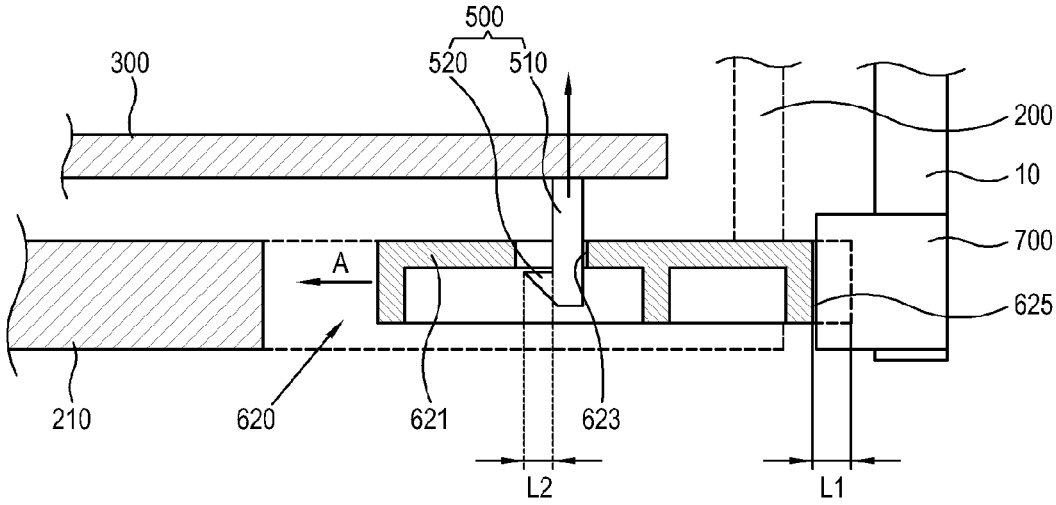
FIG. 7 is a partial sectional view illustrating the locking assembly as illustrated in FIG. 5 viewed in the direction X1.

FIG. 6 is a partial sectional view illustrating the locking assembly 400, as illustrated in FIG. 4, viewed in the direction X1, and FIG. 7 is a partial sectional view illustrating the locking assembly 400, as illustrated in FIG. 5, viewed in the direction X1.

As illustrated in FIG. 6, when the loading plate 300 is in the standby position F2, the hook unit 520 passes through the engagement hole 623 to be engaged to the locking unit main body 621 so that the locking of the engagement unit 500 by the free end 620 can be performed. The hook unit 520 has a predetermined engagement width of L2 to be engaged to the locking unit main body 621.

In this exemplary embodiment, as illustrated in FIG. 6, an external force is not applied to the free end 620, and the pressed unit 625 protrudes out of the side wall 220.

If the cassette frame 200, as illustrated in FIG. 6, is mounted to the main body frame 10, the cassette frame 200 moves in the direction X1.

As illustrated in FIG. 7, the pressed unit 625 is pressed by the pressing unit 700 the cassette frame 200 is mounted to or detached from the main body frame 10. Since the pressed unit 625 protrudes out of the side wall 220, the side wall 220 is prevented from interfering with the pressing unit 700.

As the pressing unit 700 presses the pressed unit 625, the free end 620 moves in direction A, as illustrated by an arrow in FIG. 7, toward the hook unit 520. Accordingly, the hook unit 520 is released from the engagement hole 623, and the loading plate 300 upwardly rotates to the supplying position F1, thus allowing the engagement unit 500 to pass through the engagement hole 623. Accordingly, if the cassette frame 200 is completely mounted to the main body frame 10, the printing medium M is capable of being picked up and supplied by the pickup roller 100.

The distance that the free end 620 moves when the pressed unit 625 is pressed by the pressing unit 700 is referred to as L1. The relation between the moving distance of the free end 620 by the pressing unit 700 (L1), and the engagement width of the hook unit 520 engaged to the locking unit main body 621 (L2), satisfies the following the Expression 2.

$$1.5 \leqq L1/L2 \leqq 3.0 \qquad \text{Expression 2}$$

Here, L1 means the moving distance of the free end 620 by the pressing unit 700, and L2 means the length of the engagement width of the hook unit 520 passing through the engagement hole 623 to be engaged to the locking unit main body 621. If L1 is equal to or more than 1.5 times of L2, the hook unit 510 can be easily released when the free end 620 is moved by the pressing unit 700. L1 may be less than or equal to three times L2 in order to address a contraction problem according to the material of the locking unit 600.

Hereinafter, a process of mounting the cassette frame 200 to the main body frame 10 after loading the printing medium M therein will be described by referring to FIGS. 1 to 7.

When the cassette frame 200 is separated from the main body frame 10, a user loads the printing medium M on the loading plate 300, and presses downward. Accordingly, the user's downward force on the loading plate 300 overcomes the elastic force of the elastic member 320 to rotate the loading plate 300 to the standby position F2 (refer to FIG. 2).

When the user loads the printing medium M, the engagement unit main body 510 passes through the engagement hole 623, and the hook unit 520 is engaged to the locking unit main body 621. Accordingly, the loading plate 300 maintains the standby position F2 (refer to FIGS. 4 and 6).

The user moves the cassette frame 200 in the direction X1 so that the cassette frame 200 can be mounted to the main body frame 10 (refer to FIG. 3).

As the cassette frame 200 moves, the pressed unit 625 is pressed by the pressing unit 700. Accordingly, the free end 620 moves towards the pressed position, and the engagement hole 623 is separated from the hook unit 520. The engagement of the hook unit 520 with respect to the locking unit main body 621 is withdrawn, thereby unlocking the engagement unit 500 from the locking unit 600. Accordingly, the loading plate 300 moves upwards to the supplying position F1 (refer to FIGS. 5 and 7).

If the mounting of the cassette frame 200 with respect to the main body frame 10 is completed, the loading plate 300 maintains the supplying position F1, and presses the printing medium M against the pickup roller 100 with a uniform pressure. Accordingly, if a printing command is applied to the image forming apparatus 1, the pickup roller 100 supplies the printing medium M to the image forming unit 30 so that an image can be formed (refer to FIG. 1).

The engagement unit 500 may be disposed on the loading plate 300, the engagement unit 500 may be locked by the locking unit 600 integral to the cassette frame 200, and the locking of the engagement unit 500 to the locking unit 600 may be released by the pressing unit 700. Accordingly, the loading plate 300 can maintain the standby position F2 with the simple configuration.

According to the present general inventive concept, a locking unit 600 integral with a cassette frame 200 is embodied to lock a loading plate in a standby position, thereby simplifying the configuration thereof.

Also, since the number components is reduced by employing the locking unit integral to the cassette frame, tolerance generated among the conventional assembling components can be excluded, thereby preventing operation deterioration due to the tolerance among the components.

Additionally, the locking unit can be formed together when the cassette frame is manufactured by integration of the configuration, thereby simplifying the manufacturing process.

Also, a spring applied to the conventional latch configuration can be excluded, thereby preventing operation deterioration due to an elastic force decrease of the spring.

Although a few exemplary embodiments of the present general inventive concept have been illustrated and described, it will be appreciated by those skilled in the art that changes may be made in these exemplary embodiments without departing from the principles and spirit of the general inventive concept, the scope of which is defined in the appended claims and their equivalents.

What is claimed is:

1. A medium supplying unit of an image forming apparatus, comprising:

a cassette frame to be mounted to or detached from a main body frame;

a loading plate to load a printing medium, and is disposed adjacent to the cassette frame to move between a supplying position and a standby position; and a locking assembly including an engagement unit formed on the loading plate and a locking unit formed on the cassette frame to selectively engage the engagement unit, the locking unit comprising:

a stationary end extending from the cassette frame, a free end to lock the engagement unit if the loading plate is positioned in the standby position, and to move the free end in a direction to unlock the engagement unit by applying a pressing force so that the loading plate can move to the supplying position when mounting the cassette frame, and an engagement hole through which the engagement unit passes.

2. The medium supplying unit according to claim 1, wherein the locking assembly further comprises:

a pressing unit which is disposed adjacent to the main body frame to press the free end in the direction to unlock the engagement unit when mounting the cassette frame.

3. The medium supplying unit according to claim 2, wherein the free end comprises:

a locking unit main body which extends from the stationary end to lock the engagement unit thereto, and a pressed unit which extends from the locking unit main body, and is pressed by the pressing unit to move the free end.

4. The medium supplying unit according to claim 3, wherein an external surface of the pressed unit has a round shape.

5. The medium supplying unit according to claim 3, wherein the engagement unit comprises:

a hook unit which is formed at an end part of the engagement unit to engage and be released from the locking unit main body.

6. The medium supplying unit according to claim 5, wherein the locking unit main body is formed with the engagement hole through which the engagement unit passes, and the hook unit is engaged to the engagement hole.

7. The medium supplying unit according to claim 5, wherein a relationship between a moving distance L1 of the free end by the pressing unit, and an engagement width L2 of the hook unit which is engaged to the locking unit main body satisfies the equation:

$$1.5 \leqq L1/L2 \leqq 3.0.$$

8. The medium supplying unit according to claim 2, wherein the pressing unit comprises an incline unit which presses the free end so that free end can gradually move when mounting and detaching the cassette frame.

9. The medium supplying unit according to claim 1, wherein the locking unit comprises:

a frame structure which forms an external surface of the free end by a frame which extends from the stationary end.

10. The medium supplying unit according to claim 9, wherein a relationship between the width W1 of the stationary end, and the width W2 of the frame which forms the free end satisfies the equation:

$$2.0 \leqq W1/W2 \leqq 3.0.$$

11. The medium supplying unit according to claim 1, wherein the locking unit is integrally formed to the cassette frame.

12. An image forming apparatus, comprising:

an image forming unit to form an image on a printing medium; and a medium supplying unit to supply the printing medium to the image forming unit, the medium supplying unit comprising:

a cassette frame to be mounted to or detached from a main body frame;

a loading plate to load a printing medium, and is disposed adjacent to the cassette frame to move between a supplying position and a standby position; and a locking assembly including an engagement unit formed on the loading plate and a locking unit formed on the cassette frame to selectively engage the engagement unit, the locking unit comprising:

a stationary end extending from the cassette frame, a free end to lock the engagement unit if the loading plate is positioned in the standby position, and to move the free end in a direction to unlock the engagement unit by applying a pressing force so that the loading plate can move to the supplying position when mounting the cassette frame, and an engagement hole through which the engagement unit passes.

13. The image forming apparatus according to claim 12, wherein the locking unit is integrally formed to the cassette frame.

14. A locking assembly usable with a loading plate of a medium supplying unit of an image forming apparatus, the locking assembly comprising:

an engagement unit formed on a surface of the loading plate; and a locking unit formed on the cassette frame that selectively engages the engagement to lock the engagement unit when the locking unit is in an original position to lock the loading plate in a standby position and to unlock the engagement unit when the locking unit is in a pressed position to release the loading plate from the standby position, said locking unit including an engagement hole to accommodate the engagement unit.

15. The locking assembly of claim 14, further comprising:

a pressing unit to move the locking unit between the original position and the pressed position.

16. The locking assembly of claim 15, wherein the locking unit further comprises:

a stationary end and a free end extending from the stationary end, the free end including a locking unit main body to facilitate the locking of the engagement unit, and a pressed unit to be pressed by the pressing unit.

17. The locking assembly of claim 16, wherein the engagement unit comprises:

a main body to pass through the engagement hole, and a hook unit to engage the locking unit main body in order to lock the engagement unit.

18. The locking assembly of claim 16, wherein the pressing unit comprises:

a first incline unit to move the free end from the original position to the pressed position, and a second incline unit to move the free end from the pressed position to the original position.

19. A cassette tray attachable to an image forming apparatus, the cassette tray frame comprising:

a locking unit integrally formed from the cassette tray to move between a locked state and an unlocked state, the locking unit including an engagement hole formed therethrough; and a loading plate having one end rotatably coupled to the cassette tray to position the loading plate in one of a supply position and a standby position, the loading plate including an engagement unit extending therefrom, wherein the engagement unit extends through the engagement hole and engages the locking unit to maintain the loading plate in the standby position while the locking unit exists in the locked state in response to weight exerted from printing medium disposed on the loading plate.

20. The cassette tray of claim 19, wherein the locking unit includes a pressed unit to be engaged by a pressing unit of the image forming apparatus to move the locking unit into the unlocked state in response to attaching the cassette tray to the image forming apparatus, and wherein the loading plate is placed into the supply position in response to moving the locking unit into the unlocked state.

* * * * *